US009646565B2

(12) United States Patent
Douglas et al.

(10) Patent No.: US 9,646,565 B2
(45) Date of Patent: May 9, 2017

(54) CONFIGURABLE INFORMATION HANDLING SYSTEM DISPLAY COMMUNICATION LINK

(75) Inventors: David W. Douglas, Austin, TX (US); Jeffrey Thelen, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 123 days.

(21) Appl. No.: 13/495,470

(22) Filed: Jun. 13, 2012

(65) Prior Publication Data

US 2013/0335430 A1 Dec. 19, 2013

(51) Int. Cl.
*G09G 5/00* (2006.01)

(52) U.S. Cl.
CPC ..... *G09G 5/006* (2013.01); *G09G 2350/00* (2013.01); *G09G 2370/04* (2013.01); *G09G 2370/10* (2013.01)

(58) Field of Classification Search
CPC ..... G06T 1/00
USPC ..... 345/520; 710/2, 62
See application file for complete search history.

(56) References Cited

U.S. PATENT DOCUMENTS 5,630,065 A * 5/1997 Ishii ..... 370/498
5,812,789 A * 9/1998 Diaz et al. ..... 709/247
6,284,978 B1 9/2001 Pavillard et al.
6,693,510 B1 * 2/2004 Yamaguchi ..... H04N 7/147 340/7.2
6,738,856 B1 5/2004 Milley et al.
6,909,436 B1 * 6/2005 Pianykh et al. ..... 345/619
7,355,844 B2 4/2008 Lauffer et al.
7,567,592 B2 * 7/2009 Kobayashi ..... G06F 3/14 345/208
7,694,027 B2 * 4/2010 Montag ..... 710/7
8,051,217 B2 11/2011 Goodart et al.
8,442,311 B1 * 5/2013 Hobbs et al. ..... 382/166
8,799,537 B1 * 8/2014 Zhu ..... G06F 13/385 710/14
8,804,508 B1 * 8/2014 Hobbs ..... 370/230
2002/0027613 A1 3/2002 Tajima
2002/0030637 A1 * 3/2002 Mann ..... 345/8
2006/0068049 A1 * 3/2006 Nishizawa ..... 425/145
2007/0117586 A1 * 5/2007 Billmaier et al. ..... 455/552.1
2008/0147928 A1 * 6/2008 Nicolet et al. ..... 710/62
2008/0147929 A1 * 6/2008 Glatron et al. ..... 710/63
2008/0172501 A1 * 7/2008 Goodart ..... G06F 13/40 710/33
2008/0224712 A1 * 9/2008 Peyton et al. ..... 324/533
(Continued)

FOREIGN PATENT DOCUMENTS

JP 2008118561 A * 5/2008

OTHER PUBLICATIONS

Wiley, DisplayPort Technical Overview, IEEE International Conference on Consumer Electronics, pp. 1-40.*

*Primary Examiner* — Ryan M Gray
(74) *Attorney, Agent, or Firm* — Terrile, Cannatti, Chambers & Holland, LLP; Robert W. Holland

(57) ABSTRACT

A display cable supports communication of display information and peripheral information between a display and an information handling system by selectively adapting data links of the display cable to include peripheral information. The data links can switch between display information and peripheral information communication or can include identifier information to support switching of both types of information on a common data link.

19 Claims, 2 Drawing Sheets

(56) References Cited

U.S. PATENT DOCUMENTS

| | | | | |
|---|---|---|---|---|
| 2008/0288707 | A1* | 11/2008 | Nicolet | 710/310 |
| 2009/0195706 | A1* | 8/2009 | Kikkawa et al. | 348/739 |
| 2009/0262753 | A1* | 10/2009 | On et al. | 370/466 |
| 2009/0288424 | A1* | 11/2009 | Leblond | 62/3.3 |
| 2010/0076616 | A1* | 3/2010 | Kagan | 700/295 |
| 2011/0013681 | A1* | 1/2011 | Zou | G06F 3/14 375/222 |
| 2011/0109792 | A1* | 5/2011 | Montag | 348/390.1 |
| 2011/0243035 | A1* | 10/2011 | Hall | H04L 5/1415 370/276 |
| 2012/0005394 | A1 | 1/2012 | Goodart et al. | |
| 2012/0047535 | A1* | 2/2012 | Bennett et al. | 725/62 |
| 2012/0059952 | A1* | 3/2012 | Kim et al. | 709/233 |
| 2012/0062800 | A1* | 3/2012 | Sisto | G09G 5/006 348/660 |
| 2013/0125006 | A1* | 5/2013 | Rule et al. | 715/738 |
| 2013/0178203 | A1* | 7/2013 | Venkataraman | 455/423 |
| 2013/0275629 | A1* | 10/2013 | Hall | G06F 13/385 710/14 |
| 2014/0237142 | A1* | 8/2014 | Jaussi | G06F 13/14 710/12 |

* cited by examiner

CONFIGURABLE INFORMATION HANDLING SYSTEM DISPLAY COMMUNICATION LINK

BACKGROUND OF THE INVENTION

Field of the Invention

The present invention relates in general to the field of information handling system display device communication, and more particularly to a configurable information handling system display communication link.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Often, information handling systems process information with the goal of presenting results of the processing at a display for an end user. Displays typically use a large number of pixels, each of which presents a color so that the totality of pixels presents an image. For example, a high definition display has a native resolution of at least 1920×1080 pixels. Generally, once an information handling system has generated information for presentation at a display, a graphics processor of the information handling system creates pixel values from the information that create the visual image at the display. The graphics system communicates the pixel values to a timing controller, which sets the pixel values to present the image with each pixel having a color defined by its pixel value. Static images, such as word processing documents, do not change pixel values very often so that the same values are repeatedly refreshed at the display. Dynamic images, such as movies, can change pixel values quite rapidly as images move on the display. In order to show moving images with clarity, large amounts of data can be sent from an information handling system to a display. In order to accommodate communication of pixel values to a display, the industry has developed a variety of standards for sending pixel values as digital information, including the Digital Visual Interface (DVI), High-Definition Multi-Media Interface (HDMI®) and DISPLAYPORT standards.

The DISPLAYPORT standard defines a cable and interface that communicate pixel values from a graphics system to a display on four unidirectional data serial links and also includes a bi-directional auxiliary link that communicates management information between the graphics system and display. For example, the auxiliary link allows the display to provide an identifier to the graphics system for automated setup. The DISPLAYPORT standard calls for a relatively low bandwidth across the auxiliary link, however, one alternative to the standard auxiliary link that provides increased bandwidth on the auxiliary link is to use a USB link as the auxiliary link. Having additional bandwidth allows communication of additional information between the display and graphics system, such as information associated with peripherals coupled to the display. For example, a mouse, video camera, memory card reader or speakers can interface with a port or wireless transceiver at the display and then use the USB auxiliary link to communicate with the information handling system through a DISPLAYPORT cable. The extra bandwidth provided by the USB serial link reduces the number of separate cables that are needed to interface the display with its peripherals. If even more bandwidth is needed, one alternative approach is to support bi-directional communication with the unidirectional data serial links that normally communicate pixel values. DISPLAYPORT can generally support the resolution of high definition displays with just two unidirectional data serial links so that the two remaining data serial links can be "borrowed" to support communication of other data, such as with the PCIe or USB protocols. However, "borrowing" two data serial links to establish one PCIe link provides a limited solution that may not efficiently use available bandwidth. As display resolution increases, "borrowing" display data links to create a PCIe link will impact the presentation of images at the display due to restricted bandwidth through the two data links.

SUMMARY OF THE INVENTION

Therefore a need has arisen for a system and method which supports presentation of information at a display through a cable that selectively includes non-pixel data.

In accordance with the present invention, a system and method are provided which substantially reduce the disadvantages and problems associated with previous methods and systems for communicating information between a display and an information handling system. A protocol selection controller adapts the protocol used on each of plural data links of a display cable to communicate peripheral and display information between a display and an information handling system through the display cable. The data links of the display cable can adapt to communicate peripheral information and display information with the peripheral information communicated in a selected of plural protocols.

More specifically, an information handling system has plural components disposed in a housing that cooperate to generate information for presentation of images at a display. A graphics system processes the information to generate pixel values that define the image at the display and provide the pixel values at a graphics connector for communication to a display, such as a DISPLAYPORT connector that communicates uncompressed pixel values in packets through a DISPLAYPORT cable having an auxiliary link and four data links A switching device interfaced with the graphics connector selectively adapts the auxiliary link and data lines to communicate peripheral information between the display and the information handling systems, such as video from webcam, inputs from a mouse, or information from a transceiver connected as a peripheral to the display. A protocol selection controller associated with the switching device determines the protocol used by the peripheral and adapts one or more data links to communicate with the protocol, such as USB, 1394, SERIAL ATA (SATA) and PCIe protocols. In one embodiment, the protocol selection controller configures a data link to communicate in the selected protocol. In an alternative embodiment, the protocol selection controller includes identifier information with information sent across a data link so that information is communicated across the data link in plural protocols. A bandwidth negotiator monitors bandwidth demands of the graphics system to adjust the availability of data links for use in communication of peripheral information.

The present invention provides a number of important technical advantages. One example of an important technical advantage is that bandwidth in a display cable selectively allocates between display and peripheral protocols for more efficient communication of information between a display and information handling system. For example, data lanes of a DISPLAYPORT cable automatically transition between communication of peripheral information and display information as an end user selects peripheral functions associated with a display, such as the use of a webcam, a mouse, a wireless transceiver or other peripheral operating in conjunction with the display. Switching peripheral and display data over all four data lines provides flexibility to respond to surges in data with minimal impact on performance, such as when motion-intensive images are presented at a display or files are transferred through a wireless transceiver at a display.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Data links of a DISPLAYPORT cable are selectively adapted to communicate one or more of plural protocols to support interaction of peripherals coupled to a display with an information handling system coupled to the display. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
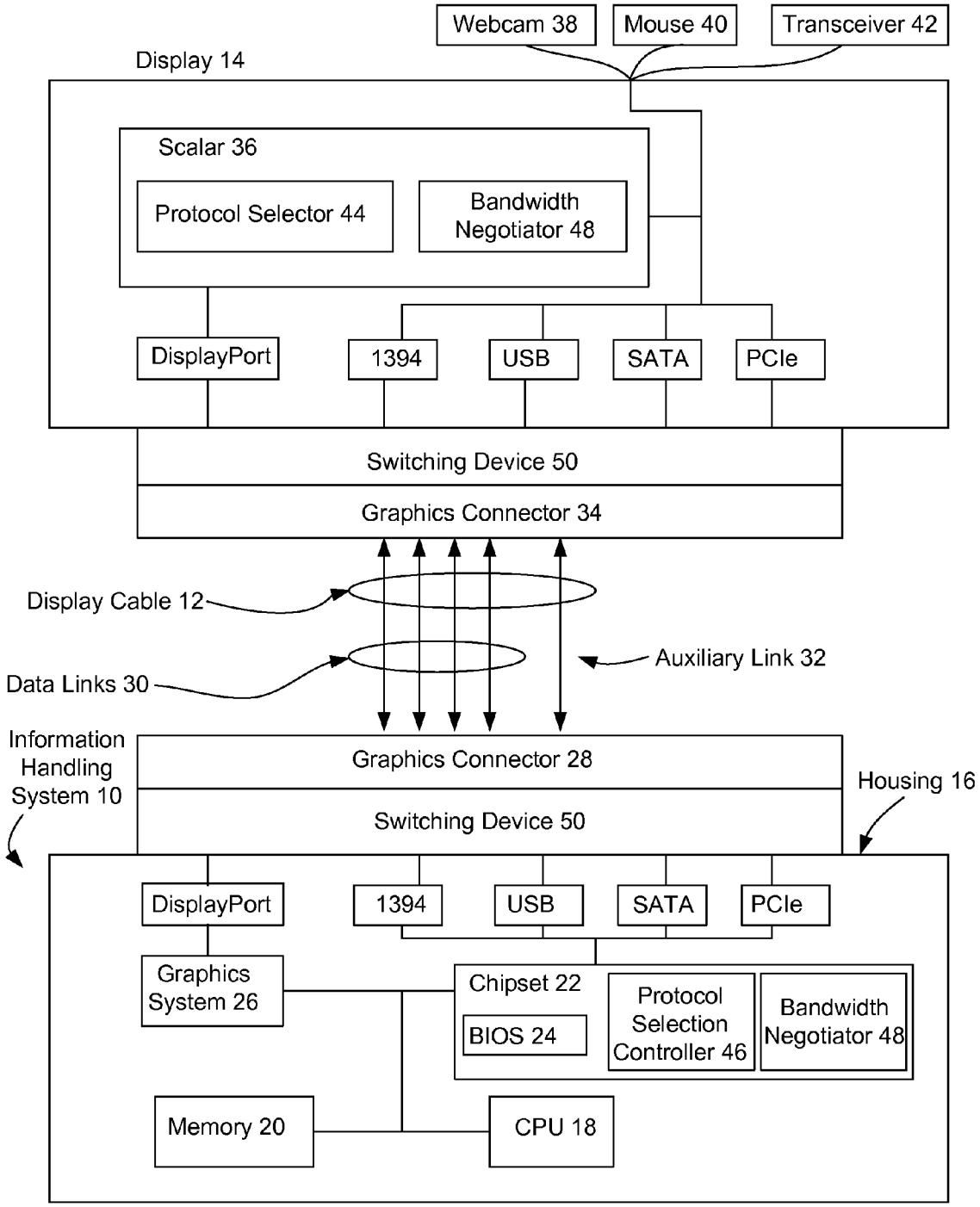
FIG. 1 depicts a block diagram of an information handling system interfaced through a display cable with a display to communicate peripheral information between the display and information handling system through the display cable.

Referring now to FIG. 1, a block diagram depicts an information handling system 10 interfaced through a display cable 12 with a display 14 to communicate peripheral information between display 14 and information handling system 10 through display cable 12. Information handling system 10 has a housing 16 that encloses components that cooperate information, such as a CPU 18 that executes instructions, memory 20 that stores instructions and information, a chipset 22 that supports a BIOS 24 to coordinate information processing, and a graphics system 26 that processes information to generate pixel values for use by a display. Graphics system 26 interfaces with a graphics connector 28 to provide pixel values to display cable 12. For example, graphics connector 28 is a DISPLAYPORT port that accepts a DISPLAYPORT cable to communicate information across four data links 30 under management provided by one auxiliary link 32. Display cable 12 communicates pixel values to a display graphics connector 34, which provides the pixel values to a scalar 36 or other timing controller for presenting images at a display by applying the pixel values at pixels of the display. Scalar 36 includes logic that communicates management information with graphics system 26 through auxiliary link 32 to coordinate communication of pixel values. For example, DISPLAYPORT communicates the pixel values with packets according to the DISPLAYPORT standard.

During normal operations, graphics system 26 communicates pixel values to display 14 for presentation as visual images. In some instances, a peripheral interfaced with display 14 requests to send information through display cable 12 to information handling system 10. For example, peripherals interfaced with display 14 might include a webcam 38, a mouse 40, a wireless transceiver 42 or other types of peripherals. In one example embodiment, an end user who initiates a videoconference with webcam 38 causes webcam 38 to send a request through auxiliary link 32 to information handling system 10 for authorization to send images from webcam 38 through display cable 12 to chipset 22 for communication through a network interface of information handling system 10. Requests to send peripheral information through display cable 12 are sent from the peripheral to a protocol selector 44 running as firmware on scalar 36 or other processing resources of display 14. Protocol selector determines the protocol for use with the peripheral and communicates the desired protocol to a protocol selection controller 46 of information handling system 10 through auxiliary link 32. In some instances, protocol selector 44 provides a list of protocols and associated transmission parameters to protocol selection controller 46 so that a protocol selection is available from plural available protocols to support communication with the peripheral based upon bandwidth available across display cable 12. Bandwidth negotiators 48 communicating through auxiliary link 32 negotiate for the amount of bandwidth available to communicate the peripheral information. In some instances, the amount of bandwidth changes as the images presented on display 14 change. For example, bandwidth negotiators 48 might assign all four data links 30 for transmission of peripheral information during a display refresh mode of operation or might use all four data links 30 for communicating pixel values when high resolution moving images are presented at display 14.

Once protocol selection controller 46 determines a protocol for communicating peripheral information through display cable 12, protocol selection controller 46 configures a switching device 50 of graphics connector 28 to establish the communication of peripheral information. A parallel process by protocol selector 44 is performed at display 14 with a switching device 50 of the display graphics connector 34. Switching device 50 communicates peripheral information over display cable 12 in several ways. In one embodiment, if adequate bandwidth exists to communicate display pixel values through less than all data links 30, protocol selection controller 46 assigns one or more data links 30 for exclusive use by the selected peripheral protocol. Alternatively, protocol selection controller 46 sends peripheral information in one direction on a data link 30 while sharing bandwidth of auxiliary link 32 to send peripheral information in the other direction. In another alternative embodiment, protocol selection controller 46 provides packet identification to send peripheral information for plural protocols and plural peripherals through a common data link 30. In yet another alternative embodiment, protocol selection controller 46 includes both display and peripheral information on a common data link 30.

Switching device 50 communicates information with graphics system 26 or chipset 22 based upon the protocol of the data link 30 that transmits the information or the identifier associated with the information. For example, if a data link 30 is assigned a peripheral protocol, then information received at switching device 50 from that data link 30 is switched to chipset 22. If a data link 30 is assigned to communicate display pixel values, then information received at switching device 50 from that data link 30 is switched to scalar 36. If a data link 30 or auxiliary link 32 is assigned to communicate both display and peripheral information, then an identifier of a simple header on each packet of information indicates to switching device 50 where to communicate the information. For example, DISPLAYPORT packets are used to communicate all of the information by encapsulating information having other protocols and adding a short header that identifies the encapsulated protocol. This allows allocation of bandwidth across display cable 12 with greater granularity for improved usage of available bandwidth.

In an embodiment where DISPLAYPORT ("DP") data links are individually assigned peripheral protocols, the following table illustrates some examples of how information is communicated.

Possible Lane configurations via DP

| | Lane 1 | Lane 2 | Lane 3 | Lane 4 |
|---|---|---|---|---|
| 4 lane DP | DP | DP | DP | DP |
| 2 lane DP | DP | DP | PCIe | |
| | DP | DP | SATA | |
| | DP | DP | USB | USB |
| | DP | DP | USB | 1394 |
| | DP | DP | 1394 | 1394 |
| 1 lane DP | DP | USB | PCIe | |
| | DP | 1394 | PCIe | |
| | DP | USB | SATA | |
| | DP | 1394 | SATA | |
| | DP | 1394 | 1394 | 1394 |
| | DP | 1394 | 1394 | USB |
| | DP | 1394 | USB | USB |

-continued

Possible Lane configurations via DP

| | Lane 1 | Lane 2 | Lane 3 | Lane 4 |
|---|---|---|---|---|
| | DP | USB | USB | USB |
| No DP lane | 1394 | USB | SATA | |
| | 1394 | USB | PCIe | |
| | 1394 | USB | USB | USB |
| | 1394 | 1394 | USB | USB |
| | 1394 | 1394 | 1394 | USB |
| | 1394 | 1394 | 1394 | 1394 |

Notes:
1. Only 1, 2, and 4 lane configurations are allowed under the DP specification
2. No DP lanes could exist if Display video is fed via 1394.
3. Aux channel used to re-configure DP link/lanes.

DISPLAYPORT allows communication of different amounts of pixel values with 1, 2, or 4 data links configured to communicate display information. In one embodiment, an alternative type of display protocol may be used to communicate display information through DISPLAYPORT data links so that no DISPLAYPORT pixel values are sent. For instance, a DISPLAYPORT data link configured to use the 1394 protocol can send display information to support presentation of visual images at a display. The auxiliary channel is available to communicate protocol selections between information handling system 10 and display 14 and can also provide shared bandwidth to support other protocols. For example, a PCIe data link sending peripheral information needs bi-lateral communication, however, the PCIe data communicated to the peripheral is typically minimal and may be sent over bandwidth shared with other protocols over other data links or the auxiliary link.

Figure 2:
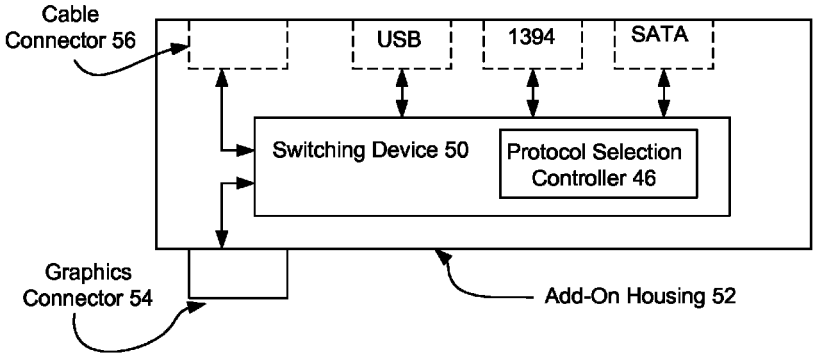
FIG. 2 depicts one embodiment of a system for switching display and peripheral information at data links of a display cable with a separate attachable housing.

Referring now to FIG. 2, one embodiment is depicted of a system for switching display and peripheral information at data links of a display cable with a separate attachable housing 52. Housing 52 includes a switching device 50 and protocol selection controller 46 to support adaption of DISPLAYPORT data links to display and peripheral information. On one portion of housing 52, a graphics connector 54 couples to an information handling system or display graphics port while, on another portion of the housing 52 a cable connector 56 couples to a display cable. Housing 52 adapts an existing graphics port to support communication of peripheral information by adding the capabilities for supporting selection of protocols with logic and components disposed in housing 52. In the depicted embodiment, peripheral ports 58 are disposed in housing 52 so that peripheral device couple to the peripheral ports to send peripheral information through a display cable. Thus, for instance, a DISPLAYPORT compatible display that lacks logic to send peripheral information through a DISPLAYPORT cable is retrofitted to do so.

Figure 3:
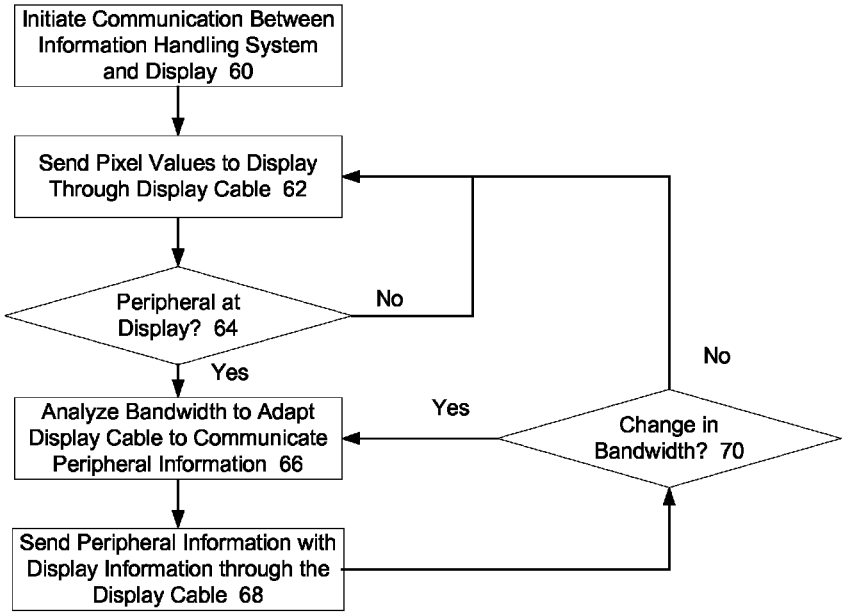
FIG. 3 depicts a flow diagram of a process for adapting a display cable to communicate display and peripheral information.

Referring now to FIG. 3, a flow diagram depicts a process for adapting a display cable to communicate display and peripheral information. The process begins at step 60 with institution of communication of display information between an information handling system and display, such as in accordance with the DISPLAYPORT standard. At step 62, pixel values provided by the information handling system are communicated through the cable to the display for presentation of visual images at the display. At step 64, a determination is made of whether a peripheral is interfaced with the display for sending peripheral information from the display to the information handling system. If no peripherals are interfaced with the display to send information to the information handling system, the process returns to step 62.

If at step 64 a peripheral is interfaced with the display, the process continues to step 66 to analyze the bandwidth available to adapt the display cable for communication of peripheral information. The amount of bandwidth used by the display and other peripherals may result in restricted bandwidth for the peripheral. The amount of bandwidth may also determine the type of switching performed by a switching device for sending peripheral information through the display cable. For example, restricted bandwidth can result in the sharing of a data link between a peripheral and other peripherals or between a peripheral and display information. At step 68, peripheral information is communicated over the display cable as determined based upon the available bandwidth. At step 70, a determination is made of whether a change has occurred in available bandwidth, such as when an increase in display usage of bandwidth occurs due to higher resolution of images or moving images presented at the display or when a peripheral is turned off. If a change has occurred, the process returns to step 66 to re-analyze the available bandwidth. If no change has occurred, the process continues to step 62 to send peripheral information with display information.

Although the present invention has been described in detail, it should be understood that various changes, substitutions and alterations can be made hereto without departing from the spirit and scope of the invention as defined by the appended claims.

What is claimed is:

1. An information handling system comprising:

a housing;

components disposed in the housing and operable to cooperate to process information;

a graphics system disposed in the housing and interfaced with the components, the graphics system operable to process the information to generate pixel values for presenting the information as visual images at a display;

a graphics connector interfaced with the graphics system and operable to communicate information from the graphics system to a display cable, the graphics connector having an auxiliary link for communicating management information and plural data links for communicating the pixel values, the pixel values communicated as pixel packets of a display protocol defined to communicate visual information from a graphics system to a display;

a chipset having a protocol selection controller interfaced with the graphics system and operable to adapt a protocol used on each of the plural data links based upon one or more predetermined factors; and a bandwidth negotiator operable to run on the chipset to communicate through the auxiliary link with the display to negotiate bandwidth available to communicate peripheral information based at least in part on bandwidth used to communicate pixel values in pixel data packets, and to assign one or more data links to communicate peripheral information based upon the negotiated bandwidth, the one or more data links configured to selectively communicate between each of the three communication configurations consisting of: the pixel data alone, the peripheral information alone, and the pixel data and peripheral information intermixed and identified by a packet header value;

wherein all the pixel and peripheral information sent on the plural data links is sent as pixel packets and the peripheral information is encapsulated in the pixel packets having header values, the header values identifying the encapsulated peripheral information protocol.

2. The information handling system of claim 1 wherein the protocol selection controller adapts the protocol by selecting one or more of DisplayPort, 1394, USB, PCIe, and SATA protocols for use on one or more of the plural data links.

3. The information handling system of claim 1 wherein the one or more predetermined factors comprise the protocol associated with a peripheral device connected to the display and generating information for communication to the information handling system.

4. The information handling system of claim 3 wherein the peripheral device comprises a webcam connected to the display.

5. The information handling system of claim 3 wherein the peripheral comprises a wireless transceiver connected to the display.

6. The information handling system of claim 1 wherein the one or more predetermined factors comprise a bandwidth associated with uninterrupted communication of the pixel values from the information handling system to the display.

7. The information handling system of claim 1 wherein the protocol selection controller further comprises a switching device operable to include an identifier with information for communication through the data links, the identifier associated with a protocol of the information, and to switch the information through any of the data links by reference to the identifier.

8. The information handling system of claim 7 wherein the information comprises packets and the identifier comprises a packet header.

9. The information handling system of claim 1 wherein the protocol selection controller comprises a protocol selection controller housing separate from the graphics connector, the protocol selection controller housing having first and second ends, the first end adapted to couple to the graphics connector in the place of a cable and the second end adapted to accept the cable.

10. A method for communicating between a graphics system of an information handling system graphics system and a display through a display cable, the method comprising:

exchanging management information between the graphics system and the display through an auxiliary link of the display cable;

transmitting pixel values from the information handling system to the display through plural data links of the display cable, the pixel values communicated in display protocol packets, the display protocol defined to communicate visual information as pixel values from a graphics system to a display;

analyzing bandwidth available to adapt one or more of the plural data links to communicate peripheral information through the data links, the analyzing supported at least in part with communications through the auxiliary link, the analyzing bandwidth including at least analyzing image resolution associated with pixel values transmitted through the plural data links for presentation at the display as visual images; and selectively adapting one or more of the plural data links to transmit the peripheral information from the display to the information handling system in response to a predetermined condition based at least in part on the analyzing, the one or more data links of the display cable configured to selectively communicate between each of the three communication configurations consisting of: pixel data alone sent only in display protocol packets, the peripheral information alone, and the pixel data and peripheral information intermixed sent only as display protocol packets, the peripheral information that is sent in display protocol packets identified by a packet header value, the peripheral information communicated in a peripheral protocol encapsulated in a display protocol packet having identification of the peripheral protocol in the packet header value.

11. The method of claim 10 wherein selectively adapting further comprises switching of peripheral information and pixel values for transmission across at least one common data link of the plural data links.

12. The method of claim 11 wherein the pixel values comprise DisplayPort packets and switching peripheral information and pixel values further comprises including a header on the DisplayPort packets, the header distinguishing the pixel values from the peripheral information packets.

13. The method of claim 10 wherein selectively adapting further comprises coupling an adapter to a graphics connector of at least one of the information handling system and display, the adapter providing a connector for accepting a display cable and communicating with an auxiliary link and plural data links disposed in the display cable.

14. The method of claim 10 wherein the predetermined condition comprises a predetermined bandwidth associated with transmitting of the pixel values.

15. The method of claim 10 wherein selectively adapting further comprises selecting a peripheral protocol from plural peripheral protocols to transmit the peripheral information.

16. The method of claim 15 wherein selecting a peripheral protocol further comprises selecting first and second peripheral protocols, the first peripheral protocol for transmitting peripheral information across a first data link, the second peripheral protocol for transmitting peripheral information across a second data link.

17. The method of claim 16 wherein at least some of the peripheral information in the first peripheral protocol and second peripheral protocol are transmitted across a common data link.

18. A system for communicating display information and peripheral information between a display and an information handling system, the display information communicated in display packets defined by a display protocol to communicate visual information as pixel values from a graphics system to a display, the system comprising:

a protocol selection controller operable to communicate protocol selection information through an auxiliary link of a display cable and to apply the protocol selection information to determine a selected protocol from plural protocols for communicating peripheral information over one or more display cable data links; and a switch interfaced with the protocol selection controller and the display cable, the switch operable to coordinate communication of the peripheral information over the one or more display cable data links in the selected protocol, the one or more display cable data links configured to selectively communicate pixel data between each of the three communication configurations consisting of: the pixel data alone sent only as display protocol packets, the peripheral information alone, and the pixel data and peripheral information intermixed sent only as display protocol packets that encapsulate the peripheral information and having peripheral information identified by a packet header value;

wherein the display cable data links have the capability of selecting each of the communication configurations and peripheral information is communicated in the display protocol packets that encapsulate the peripheral information having a peripheral protocol, the packet header value identifying the peripheral protocol.

19. The system of claim 18 wherein the switch is further operable to coordinate communication of the peripheral information in the selected protocol and at least one additional of plural other protocols over a common data link.

* * * * *